United States Patent [19]

Mackey

[11] Patent Number: 5,046,742

[45] Date of Patent: Sep. 10, 1991

[54] GOLF BALL

[75] Inventor: Gary T. Mackey, 311 Country Club Dr., Argyle, Tex. 76226

[73] Assignee: Gary T. Mackey, Carrollton, Tex.

[21] Appl. No.: 455,901

[22] Filed: Dec. 26, 1989

Related U.S. Application Data

[63] Continuation of Ser. No. 271,526, Nov. 15, 1988, abandoned.

[51] Int. Cl.[5] ..... A63B 37/14

[52] U.S. Cl. ..... 273/232; 40/327

[58] Field of Search ..... 273/232, 62, 220; 40/327

[56] References Cited

U.S. PATENT DOCUMENTS

| | | | |
|---|---|---|---|
| 1,286,834 | 12/1918 | Taylor | 273/232 |
| 1,656,408 | 1/1928 | Young | 273/232 |
| 1,666,699 | 4/1928 | Hagen | 273/232 |
| 1,681,167 | 8/1928 | Bedlam | 273/232 |
| 1,716,435 | 6/1929 | Fotheringham | 273/232 |
| 2,002,726 | 5/1935 | Young | 273/232 |
| 2,106,704 | 2/1938 | Davis | 273/232 |
| 2,728,576 | 12/1955 | Martin et al. | 273/232 |
| 3,819,190 | 6/1974 | Nepela et al. | 273/232 |
| 4,090,716 | 5/1978 | Martin et al. | 273/235 A |
| 4,090,716 | 5/1978 | Martin et al. | 273/232 |
| 4,141,559 | 2/1979 | Melvin et al. | 273/232 |
| 4,142,727 | 3/1979 | Shaw et al. | 273/232 |
| 4,258,921 | 3/1981 | Worst | 273/232 |
| 4,266,773 | 4/1981 | Treadwell | 273/232 |
| 4,560,168 | 12/1985 | Aoyama | 273/232 |
| 4,653,758 | 3/1987 | Solheim | 273/232 |
| 4,681,323 | 7/1987 | Alaki et al. | 273/232 |
| 4,720,111 | 1/1988 | Yamada | 273/232 |
| 4,722,529 | 2/1988 | Shaw et al. | 273/232 |
| 4,729,567 | 3/1988 | Oka et al. | 273/232 |
| 4,729,567 | 3/1988 | Oka et al. | 273/232 |
| 4,729,861 | 3/1988 | Lynch et al. | 273/232 |

*Primary Examiner*—George J. Marlo
*Attorney, Agent, or Firm*—L. Dan Tucker

[57] ABSTRACT

A golf ball is provided with evenly and uniformly distributed dimples. The spherical surface of the golf ball is divided into thirty-two geometric shapes, comprising twelve spherical pentagons and twenty spherical hexagons. The arrangement of the dimples on the spherical surface is generally defined by the sides of the spherical pentagons and hexagons. The uniform distribution of dimples is such that the golf ball displays multiple axes of symmetry.

6 Claims, 2 Drawing Sheets

GOLF BALL

This application is a continuation of application Ser. No. 271,526, filed Nov. 15, 1988, now abandoned.

FIELD OF THE INVENTION

The present invention relates generally to golf balls and, more particularly to golf balls having an improved arrangement of dimples thereon.

DESCRIPTION OF THE PRIOR ART

The prior art in the area of golf balls is crowded, with a multitude of patents addressing practically every conceivable aspect of golf ball design and manufacture. Existing patents cover the materials used to make golf balls, the surface configuration of golf balls (i.e. the arrangement of the dimples), the configuration of the individual dimples, as well as various methods and apparatus for manufacturing golf balls. The particular references discussed herein deal primarily with the surface configuration of golf balls, since the present invention relates to a unique arrangement of dimples which has been heretofore undisclosed in the prior art.

The ultimate goal of the prior art patents dealing with surface configuration is, simply put, to improve the overall performance of the subject golf ball. Essentially, the performance of a golf ball is a direct function of the distance, accuracy, and consistency of the ball during normal play. If the size, weight, materials, and construction of golf balls are maintained relatively constant, the performance is dependent upon the size, shape, and location of the dimples of the surface of the ball. Of these three factors, the location of the dimples has proven to be extremely critical. Typical dimple patterns disclosed in the prior art are defined by the projection of regular polyhedra, or semi-regular polyhedra derived therefrom, onto the surface of a sphere, as discussed in detail below.

When a golf ball is struck by a golf club during play, the ball is rotated about an axis at high speed in a direction opposite the direction in which the ball would rotate if it were to be rolled along the ground in the direction of travel. This rotation is commonly referred to as "backspin" by persons conversant in golf ball performance.

The benefit of utilizing dimples in the surface of a golf ball is well known to persons skilled in the art of golf ball aerodynamics. The combination of dimples and backspin creates a pressure differential about the ball as it moves forward through the air. This pressure differential, in which the pressure of the air below the ball is greater than the pressure of the air above the ball, creates a condition referred to as "lift". Lift operates to counteract the force of gravity by pushing the ball upward as it travels through the air, thus increasing the performance of the golf ball by keeping it airborne longer. Therefore, it is well known in the art that golf balls with dimples generally travel greater distances than balls without dimples when struck with equivalent blows by a golf club.

The assembly of a golf ball generally involves molding a dimpled cover around a solid or wound core. Typically, the cover is either injection molded around a core suspended by locator pins within the two halves of the mold, or the cover is separately formed in two pieces which are compression molded around a core. Either method results in a cover comprising two hemispheres separated by a parting line formed at the meeting point of the two halves of the mold. It is most common in the art to utilize compression molding for golf balls with wound cores having either solid or liquid centers, and injection molding for balls with solid cores.

Golf balls with wound cores are typically referred to as "three piece" balls because they consist of three basic components: (1) a solid or liquid-filled center; (2) rubber winding around the center, and; (3) the cover. Similarly, solid core balls are referred to as having a "two piece" construction, since they consist solely of a solid core and a cover. A third type of ball, known as a "one piece" ball, is also known in the art. As the name suggests, one piece balls are solid balls of homogenous construction made by any conventional molding method suitable for the purpose. As with balls based on the two and three piece constructions, one piece balls also contain a parting line caused by the separation point necessary for the two halves of the mold.

The composition of the cover has also proven to be a factor in overall golf ball performance. Historically, three piece balls had covers made of natural or synthetic balata, or transpolyisoprene. While such balls are still in limited production, the majority of modern golf balls use two piece construction with covers made of a durable synthetic thermoplastic resin such as Surlyn, a product of E. I. duPont de Nemours Company, Incorporated. Since different golfers prefer different constructions and materials and the performance characteristics associated therewith, it is desirable for a golf ball to be adaptable to a variety of construction methods and materials.

It is well known to those skilled in the art that the performance of a golf ball is enhanced by placing the dimples in the most perfectly symmetrical arrangement that can be devised. Accordingly, the most common practice is to employ arrangements based upon the projection of the edges of a regular polyhedron upon the surface of a sphere, there being a limited number of polyhedra available for this purpose. Perhaps the most common polyhedron presently utilized for dimple arrangement is the icosahedron, as disclosed in U.S. Pat. No. 4,729,861 issued Mar. 8, 1988 to Lynch. Other polyhedra which have been used for this purpose are the dodecahedron and the octahedron, both of which are disclosed in U.S. Pat. No. 4,142,727 issued Mar. 6, 1979 to Shaw, et al.

In addition to the practical consideration of consistent performance achieved through a symmetrical dimple pattern, golf ball manufacturers generally strive for symmetrical patterns in order to comply with the specifications of the United Stated Golf Association (USGA). While the USGA rules do not specifically address dimple patterns per se, the rules do require that golf balls have substantially identical flight characteristics when rotated 90 degrees. This specification is commonly referred to as the "symmetry rule".

Dimple patterns based on the octahedron are among the oldest designs still in use. This dimple pattern has a particular advantage over some others because octahedral patterns repeat every 90 degrees and are therefore particularly adaptable to meeting the USGA symmetry rule. Octahedral designs also include a natural equator, thus providing an inherent location at which to separate the mold. Unfortunately, golf balls utilizing the octahedral design pattern generally have inferior aerodynamic properties due to the linearity of the arrangement of dimples, which does not result in optimum lift characteristics at the lower velocities encountered during the later segments of a typical flight. Accordingly, while the use of the octahedron as the basis for the dimple pattern provides certain advantages, the overall performance of golf balls using this pattern is exceeded by other prior art patterns.

Dimple designs based on the icosahedron, for example, yield golf balls with aerodynamic properties generally superior to those based on the octahedron. Consequently, dimple patterns based on the icosahedron are in widespread use in the golf ball manufacturing industry today. Icosahedral patterns, however, do not include a naturally occurring parting line when utilized with the preferred number of dimples, thus requiring careful manipulation of the dimples to accomodate current molding methods. The necessity of adapting the dimple pattern to include a smooth equator results in inconsistent flight performance with varying ball orientation. U.S. Pat. No. 4,560,168, issued Dec. 24, 1985 to Aoyama discloses one icosahedral pattern which attempts to solve this problem by subdividing each of the twenty triangular sides of the icosahedron into four sections, with great circles being inscribed along the boundary lines of the center sections. Therefore, golf balls manufactured pursuant to Aoyama have increased linear aerodynamic properties, but the pattern does not naturally repeat every 90 degrees. As pointed out above, repetition at 90 degree intervals is desirable to facilitate compliance with the USGA symmetry rule.

It is also known in the prior art to use semi-regular polyhedra for the dimple pattern in order to achieve improved aerodynamic properties while providing a plurality of great circles at which the two hemispheres may be joined. An example of such prior art is U.S. Pat. No. 4,729,567, issued Mar. 8, 1988 to Oka, et al, which discloses the use of the icosa-dodecahedron, a semi-regular polyhedron consisting of twenty identical triangles evenly distributed among twelve identical pentagons. This pattern is simply a derivative of, and substantially the same as, the icosahedral pattern, as clearly shown in FIGS. 7A, 8A, 9A, 10A, and 11A of the Aoyama reference discussed above. The icosa-dodecahedral configuration provides six naturally occurring great circles, which is desirable, but the dimple pattern imposed thereon does not repeat at 90 degree intervals, as with the icosahedral pattern from which it is derived. Therefore, in order to improve the flight consistency and comply with the USGA symmetry rule, the Oka device requires very specific sizes and placement of the individual dimples. In light of all of the considerations discussed above, the present invention was developed to maximize the overall performance of the golf ball.

SUMMARY OF THE PRESENT INVENTION

An object of the present invention is to provide an improved golf ball having a dimple pattern which reflects a high degree of symmetry, at 90 degree intervals and otherwise. The unusually high degree of symmetry provided by the teachings of this invention allows for the even distribution of dimples about the surface of the ball, and allows for conformance with the USGA symmetry rule without requiring the use of dimples of varying sizes.

Another object of this invention is to provide an improved golf ball dimple pattern suitable for use on balls of all conventional constructions, including one, two, and three piece designs. A further object of this invention is to provide a dimple pattern which improves the performance of the golf ball regardless of the materials used in the construction thereof.

In accordance with the teachings of the present invention, there is disclosed herein a preferred embodiment of a golf ball having a symmetrical dimple pattern with multiple axes of symmetry. The unique dimple arrangement of this invention is accomplished by projecting onto a sphere a geometric prism consisting of twelve identical pentagons, and twenty identical hexagons. As distinguished from the dimple patterns disclosed in the prior art, the pattern of this invention is not defined by either a regular polyhedron or a semi-regular polyhedron derived therefrom.

With the overall dimple pattern being defined by the adjoining pentagons and hexagons, dimples of varying or identical sizes are placed within or on the boundaries of said pentagons and hexagons. In the preferred embodiment disclosed herein, three different dimple sizes are utilized, and all dimples are located within the boundaries of the pentagons and hexagons. It will be understood by those skilled in the art, however, that the number and sizes of the dimples may be varied and the dimples may be placed on the boundary lines between the hexagons and pentagons without detracting from the improved performance provided by the present invention.

These and other objects of the present invention will become apparent from the reading of the following specification, taken in conjunction with the enclosed drawings.

DETAILED DESCRIPTION OF THE PREFERRED EMBODIMENT

Figure 1:
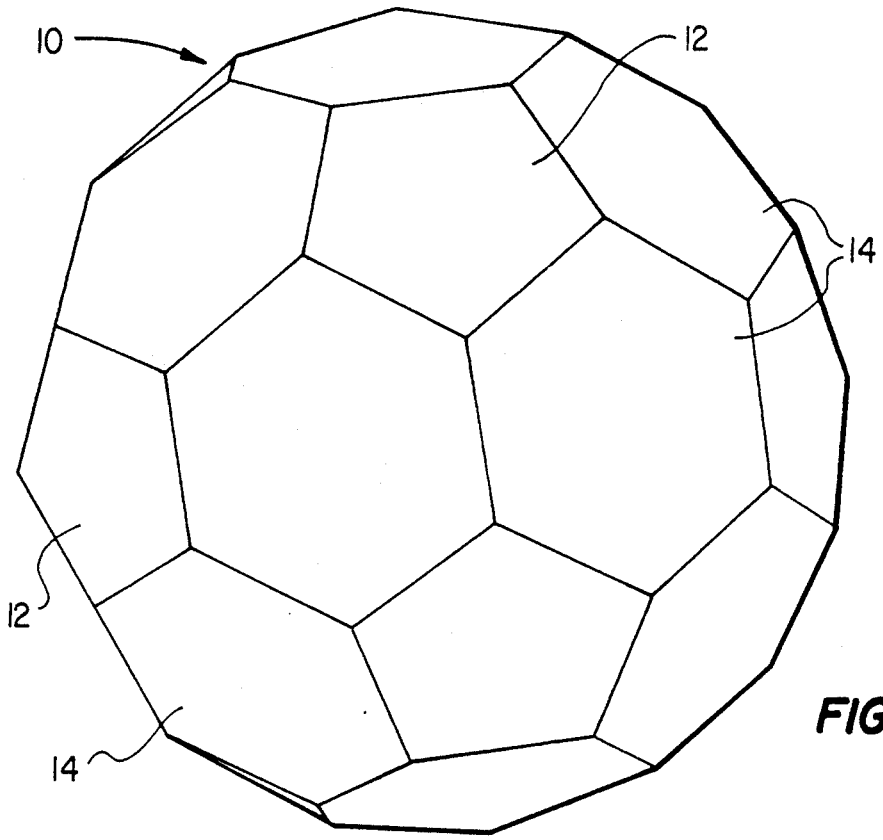
FIG. 1 is a front isometric view of the geometric prism used to define the dimple configuration of the present invention.
Figure 2:
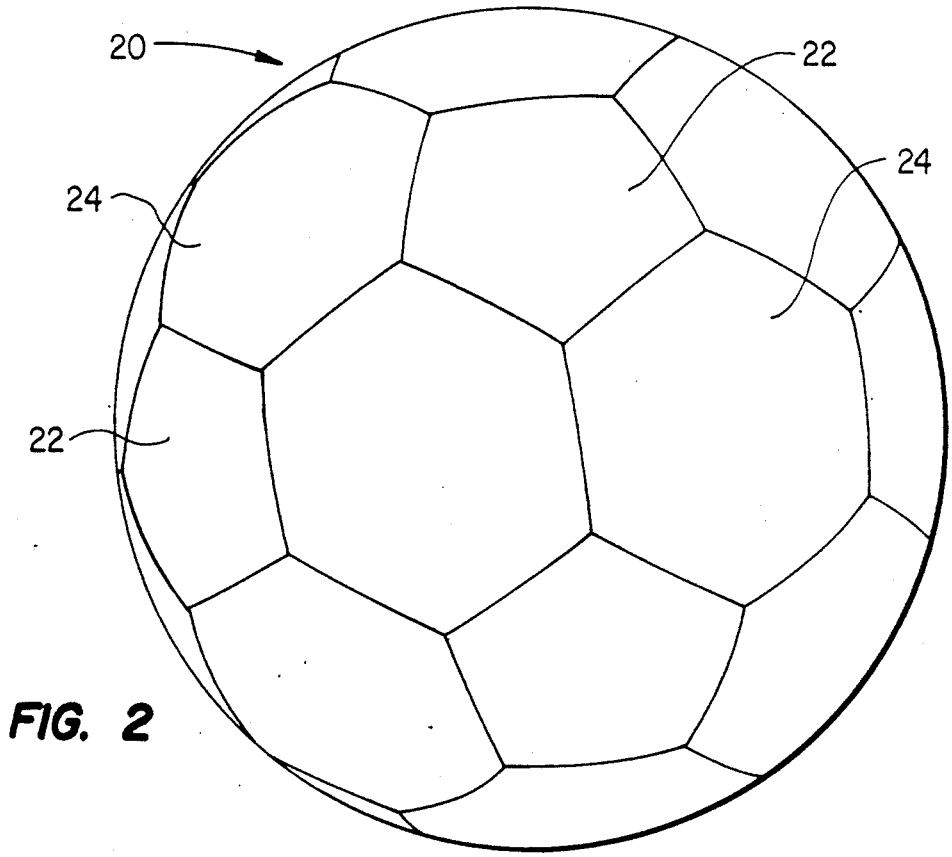
FIG. 2 is a front isometric view explanatory of how the geometric prism of FIG. 1 is projected onto the surface of a sphere.

Referring now to the geometric prism 10 illustrated in FIG. 1, the preferred embodiment of the present invention is accomplished by designing a semi-regular polyhedron having thirty-two faces, said faces comprising twelve identical pentagonal faces 12 and twenty identical hexagonal faces 14. As clearly shown in the drawings, each of said pentagonal faces 12 is contiguous with five hexagonal faces 14, while each of said hexagonal faces 14 is contiguous with three other hexagonal faces 14 and three pentagonal faces 12. With the geometric prism being projectable onto the surface of a sphere, the dimensions of the pentagonal and hexagonal faces are dictated by the dimensions of the sphere. In the case of the present invention, the sphere in question is a golf ball with dimensions controlled by the rules of the USGA. In FIG. 2, the above described geometric prism 10 has been projected onto the surface of a sphere 20, whereby the surface of said sphere is uniformly divided into spherical pentagons 22 and spherical hexagons 24.

Figure 3:
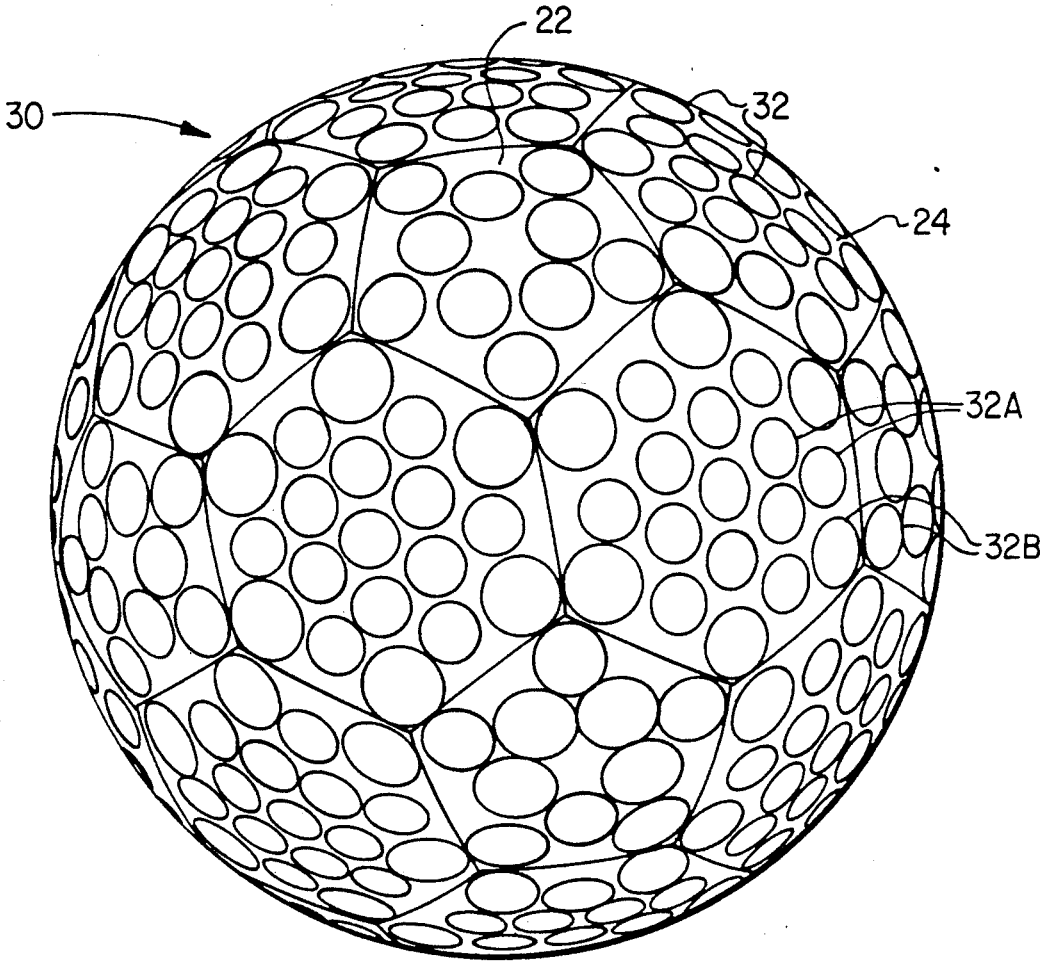
FIG. 3 is a front elevational view of a golf ball showing the arrangement of dimples in accordance with the preferred embodiment of the present invention, with the corresponding geometric shapes being inscribed thereon.

The preferred embodiment of the present golf ball is identified by numeral 30 in FIG. 3. Referring now to FIG. 3, the external surface of golf ball 30 has a plurality of dimples 32 formed therein, dimples 32 being disposed within the boundaries of spherical pentagons 22 and spherical hexagons 24. Preferably, for any given spherical pentagon 22 or spherical hexagon 24, the arrangement of dimples 32 therein is generally uniform. When used in this context, uniformity means that, if a dividing line is arbitrarily drawn through any given spherical pentagon 22 or hexagon 24 whereby the sides of said spherical pentagon or hexagon are substantially symmetric about said dividing line, the dimples 32 disposed within said spherical pentagon or hexagon are likewise symmetric about said dividing line. It is also preferred that the arrangement of dimples 32 within any given spherical pentagon 22 be identical to the arrangement of dimples 32 in the remaining spherical pentagons 22. Similarly, the arrangement of dimples 32 within a given spherical hexagon 24 is preferably identical to the arrangement of dimples 32 in the remaining spherical hexagons 24. The uniformity and repetition of the arrangement of dimples 32, in conjunction with the unique combination of spherical pentagons 22 and spherical hexagons 24, provide the unusually high degree of symmetry found in golf balls made in accordance with the teachings of this invention.

As shown in FIG. 3, golf ball 30 incorporates two different sizes of dimples 32, the different sizes being identified by labels 32A, and 32B. Additionally, dimples 32 are disposed on the preferred embodiment such that none of dimples 32 intersect any of the boundary lines defining spherical pentagons 22 and spherical hexagons 24. It is contemplated, however, that dimples 32 may be formed in any number, size or sizes suitable for the purpose, and that one or more of dimples 32 may intersect one or more boundary lines defining the spherical pentagons and hexagons without departing from the scope of the present invention.

As evident from the above detailed description, the golf ball of the present invention has a degree of symmetry heretofore unknown in the prior art. Since symmetry is a significant factor in the overall performance and U.S.G.A. qualification of a golf ball, the present invention provides a golf ball with superior aerodynamic qualities and more consistent performance than prior art devices. It is believed that golf balls formed in accordance with the teachings of this invention will fly more accurately and at least as far as any prior art golf balls regardless of ball orientation upon contact with the golf club.

The preferred method of manufacturing the golf ball of this invention is to utilize a two piece construction, as described hereinabove, with a synthetic thermoplastic cover injection molded around a solid core. The dimple pattern disclosed herein is especially well suited for the placement of location pins for injection molding wherein six pins may be located in the center of six dimples 32B. It will be clear to one skilled in the art that the teachings of this invention are equally applicable to golf balls of any conventional construction and material.

While the principle of the arrangement of dimples has been made clear, it will be immediately apparent to those skilled in the art that there are many possible modifications to the disclosed arrangement without departing from the basic spirit of the present invention. Accordingly, the following claims are intended to cover and embrace not only the specific embodiment disclosed herein, but also such modifications within the spirit and scope of this invention.

What is claimed is:

1. A golf ball having a spherical surface with a plurality of dimples formed therein, said dimples being arranged by dividing said spherical surface into twelve identical spherical pentagons and twenty identical identical spherical hexagons.

2. The golf ball according to claim 1 wherein:

all of said dimples are formed within the boundaries of said spherical pentagons and hexagons so that said dimples do not intersect the sides of any of said spherical squares and hexagons.

3. The golf ball according to claim 1 wherein: at least one of said dimples intersects at least one side of at least one of said spherical pentagons or hexagons.

4. The golf ball according to claim 1 wherein:

all of said dimples are of the same approximate size and configuration.

5. The golf ball according to claim 1 wherein:

said dimples are of varying sizes.

6. A golf ball having a spherical surface with a plurality of dimples formed therein, the arrangement of said dimples being defined by the projection of a geometric prism onto said spherical surface of said golf ball, said geometric prism comprising twelve pentagons and twenty hexagons.

* * * * *